US009401565B2

(12) United States Patent
Dobler

(10) Patent No.: US 9,401,565 B2
(45) Date of Patent: Jul. 26, 2016

(54) PLUG CONNECTOR

(71) Applicant: NEUTRIK AG, Schaan (LI)

(72) Inventor: Oliver Dobler, Eschen (LI)

(73) Assignee: NEUTRIK AG, Schaan (LI)

( * ) Notice: Subject to any disclaimer, the term of this patent is extended or adjusted under 35 U.S.C. 154(b) by 0 days.

(21) Appl. No.: 14/381,026

(22) PCT Filed: Oct. 9, 2013

(86) PCT No.: PCT/EP2013/003025
§ 371 (c)(1),
(2) Date: Aug. 26, 2014

(87) PCT Pub. No.: WO2014/075751
PCT Pub. Date: May 22, 2014

(65) Prior Publication Data

US 2015/0044898 A1 Feb. 12, 2015

(30) Foreign Application Priority Data

May 15, 2013 (DE) ..... 10 2013 008 264

(51) Int. Cl.
*H01R 13/627* (2006.01)

(52) U.S. Cl.
CPC ..... *H01R 13/6275* (2013.01)

(58) Field of Classification Search
CPC ... H01R 13/50; H01R 13/6275; H01R 13/627
USPC ..... 439/352, 633, 646, 650, 651, 652, 655, 439/660, 682, 692
See application file for complete search history.

(56) References Cited

U.S. PATENT DOCUMENTS 5,203,718 A * 4/1993 Chishima ..... H01R 13/641 439/350
5,217,390 A * 6/1993 Nozaki ..... H01R 13/641 439/353

(Continued)

FOREIGN PATENT DOCUMENTS

CN 3269753D 12/2002
CN 3274166D 1/2003

(Continued)

OTHER PUBLICATIONS

German Search Report of DE Priority Application 10 2013 008 264.1.

(Continued)

*Primary Examiner* — Tulsidas C Patel
*Assistant Examiner* — Peter G Leigh
(74) *Attorney, Agent, or Firm* — Harris Beach PLLC; Neal L. Slifkin

(57) ABSTRACT

Plug connector for an electrical and/or optical plug connection, wherein the plug connector comprises a first plug component and a second plug component, the first plug component has an elongate plug-in portion and the second plug component has an elongate receiving jacket portion with an insertion opening, and, in a position in which the first and second plug components are completely plugged one into the other, the plug-in portion is inserted into the receiving jacket portion through the insertion opening; the plug connector also comprises locking means including a locking pin for locking together the first and second plug components the locking pin being located inside the receiving jacket portion and/or the plug-in portion in the completely plugged-in position and being movable between the locking position and the unlocking position on a path of movement with a tangential component, viewed from the longitudinal center line.

15 Claims, 6 Drawing Sheets

(56) References Cited

U.S. PATENT DOCUMENTS

| | | | | | |
|---|---|---|---|---|---|
| 5,330,369 | A * | 7/1994 | Nozaki | H01R 13/641 | 439/350 |
| 5,660,558 | A * | 8/1997 | Osanai | H01R 13/6582 | 439/353 |
| 6,116,945 | A * | 9/2000 | Davis | H01R 13/5825 | 439/354 |
| D490,779 | S | 6/2004 | Lee | | |
| D506,184 | S | 6/2005 | Sirichai et al. | | |
| D510,071 | S | 9/2005 | D'Addario et al. | | |
| D512,378 | S | 12/2005 | Dobler | | |
| 6,997,733 | B2 | 2/2006 | Peng | | |
| D517,497 | S | 3/2006 | Lee | | |
| D524,738 | S | 7/2006 | Dobler | | |
| D543,154 | S | 5/2007 | Suckle et al. | | |
| D569,810 | S | 5/2008 | Victor | | |
| D587,204 | S | 2/2009 | Bachmann | | |
| 7,488,187 | B2 * | 2/2009 | Wolf | H01R 31/005 | 439/106 |
| 7,699,640 | B2 * | 4/2010 | Brekosky | H01R 13/65802 | 439/101 |
| D645,022 | S | 9/2011 | Lee et al. | | |
| D673,500 | S | 1/2013 | Feige et al. | | |
| D706,117 | S | 6/2014 | Toimil et al. | | |
| 2003/0100215 | A1 | 5/2003 | Bachman | | |
| 2006/0172578 | A1 | 8/2006 | Parsons | | |
| 2007/0049099 | A1 * | 3/2007 | Potters | H01R 13/6275 | 439/352 |
| 2009/0186503 | A1 * | 7/2009 | Dobler | H01R 27/00 | 439/172 |
| 2009/0215302 | A1 * | 8/2009 | Roberts | B23K 10/00 | 439/350 |
| 2013/0273767 | A1 * | 10/2013 | Phan | H01R 13/6271 | 439/358 |
| 2013/0288510 | A1 * | 10/2013 | Svelnis | H01R 13/6275 | 439/350 |

FOREIGN PATENT DOCUMENTS

| | | | | |
|---|---|---|---|---|
| CN | 3275196D | | 1/2003 | |
| DE | 102009007298 | B3 | 9/2010 | |
| EM | 000 152 970-0002 | | 6/2004 | |
| EM | 000 152 970-0003 | | 6/2004 | |
| EM | 000 152 970-0004 | | 6/2004 | |
| EM | 000 152 970-0006 | | 6/2004 | |
| EM | 000 445 218-0001 | | 2/2006 | |
| EM | 000 445 218-0002 | | 2/2006 | |
| EM | 000 445 218-0003 | | 2/2006 | |
| EM | 000 649025-0001 | | 3/2007 | |
| EM | 000 741 152-0001 | | 7/2007 | |
| EM | 001 229 827-0001 | | 8/2010 | |
| EM | 001 229 827-0002 | | 8/2010 | |
| EM | 001 229 827-0003 | | 8/2010 | |
| EM | 001 229 827-0004 | | 8/2010 | |
| EM | 001 229 827-0005 | | 8/2010 | |
| EM | 001 229 827-0006 | | 8/2010 | |
| EM | 001 229 827-0007 | | 8/2010 | |
| EM | 001 229 827-0008 | | 8/2010 | |
| EM | 001 229 827-0009 | | 8/2010 | |
| EM | 001 229 827-0010 | | 8/2010 | |
| EM | 001 229 827-0011 | | 8/2010 | |
| EM | 001 229 827-0012 | | 8/2010 | |
| EM | 001 371 843-0001 | | 5/2013 | |
| EM | 001 371 843-0002 | | 5/2013 | |
| EM | 001 371 843-0003 | | 5/2013 | |
| EM | 001 371 843-0004 | | 5/2013 | |
| EM | 001 371 843-0005 | | 5/2013 | |
| EM | 001 371 843-0006 | | 5/2013 | |
| EM | 001 371 843-0007 | | 5/2013 | |
| EM | 001 371 843-0008 | | 5/2013 | |
| EM | 001 371 843-0009 | | 5/2013 | |
| EM | 001 371 843-0010 | | 5/2013 | |
| EP | 0 161 835 | A2 | 11/1985 | |
| EP | 0161835 | A3 * | 9/1988 | H01R 13/6278 |
| EP | 0 757 411 | A2 | 2/1997 | |
| EP | 1 172 897 | A2 | 1/2002 | |
| EP | 0 898 333 | B1 | 2/2002 | |
| EP | 1 172 897 | A3 | 3/2003 | |
| EP | 1172897 | A3 * | 3/2003 | H01R 13/6275 |
| EP | 1 317 025 | A2 | 6/2003 | |
| EP | 1 416 588 | A1 | 5/2004 | |
| EP | 001 386 684-0001 | | 10/2013 | |
| EP | 001 386 684-0002 | | 10/2013 | |
| EP | 001 386 684-0003 | | 10/2013 | |
| EP | 001 386 684-0004 | | 10/2013 | |
| EP | 001 386 684-0005 | | 10/2013 | |
| EP | 001 386 684-0006 | | 10/2013 | |
| EP | 001 386 684-0007 | | 10/2013 | |
| EP | 001 386 684-0008 | | 10/2013 | |
| EP | 001 386 684-0009 | | 10/2013 | |
| EP | 001 386 684-0010 | | 10/2013 | |
| EP | 001 386 684-0011 | | 10/2013 | |
| EP | 001 386 684-0012 | | 10/2013 | |
| EP | 001 386 684-0013 | | 10/2013 | |
| EP | 001 386 684-0014 | | 10/2013 | |
| EP | 001 386 684-0015 | | 10/2013 | |
| GB | 2 071 928 | A | 9/1981 | |
| JP | H01-29985 | | 9/1989 | |
| JP | 05-144512 | A1 | 6/1993 | |
| JP | 2000-164296 | | 6/2000 | |
| JP | 2012-243 565 | | 12/2012 | |
| WO | WO 2004105197 | A1 * | 12/2004 | H01R 13/6273 |
| WO | WO 2005046007 | A1 * | 5/2005 | H01R 13/6275 |
| WO | WO 2008043115 | A1 * | 4/2008 | H01R 27/00 |
| WO | 2012083939 | A2 | 6/2012 | |
| WO | 2014/183821 | A1 | 11/2014 | |

OTHER PUBLICATIONS

EM Trademark Registration 009 351 297, Mar. 29, 2011.
EM Trademark Registration 009 351 305, Mar. 29, 2011.
EM Trademark Registration 003 717 303, Jul. 3, 2006.
EM Trademark Registration 003 717 361, Oct. 24, 2005.
EM Trademark Registration 002 382 786, Jul. 4, 2005.
Product Guide 2012/13; Published Mar. 21, 2012, Front Page and pp. 3, 7, 12, 13, 14, 15, 16, 17, 23-30, 50, 58, 64, 66-71, 79, 82, 83, 89-91, 94, 96, 98-99, 115-117, 120-122.

* cited by examiner

PLUG CONNECTOR

This application is a national stage application under 35 U.S.C. §371 of PCT Application No. PCT/EP2013/003025, filed Oct. 9, 2013, which claims priority to and the benefit of German Patent Application No. DE 10 2013 008 264.1 filed May 15, 2013, which is incorporated herein by reference in its entirety.

The present invention relates to a plug connector for at least an electrical and/or optical plug connection, wherein the plug connector has a first plug component and at least a second plug component, and the first plug component has at least one elongate plug-in portion and the second plug component has at least one elongate receiving jacket portion with at least one insertion opening, and the plug-in portion, in a completely plugged-in position, is pushed by the first and second plug component through the insertion opening into the receiving jacket portion and in a completely detached position of the first and second plug components, is pulled out of the receiving jacket portion, wherein the first and second plug components are arranged coaxially to each other, in relation to a common central longitudinal axis, in the completely plugged-in position and the plug connector has at least one locking means with at least one locking pin for locking together the first and second plug components in the completely plugged-in position.

Generic plug connectors are used for example in the audio sector for creating electrical connections between a cable and another cable, or a cable and an electrical device. They are used for example as microphone plugs. Generic plug connectors can also be used for creating an optic connection, e.g., to connect fiber-optic cables to each other. Mixed forms for the simultaneous transmission of electrical and optical data and/or power are also possible.

The locking means of generic plug connectors serves to prevent an undesired separation of the plug components of the plug connectors. In prior art, the locking pins are moved between the locking position and their unlocking position in a radial direction, as seen from the central longitudinal axis. They are often accessible from the outside and thus protrude outwardly from the receiving jacket portion and also the plug-in portion.

A generic plug connector of this type to create a purely electrical connection is depicted in EP 1 416 588 A1 for example. The disadvantage of these locking means conventionally seen in prior art with a locking pin that is movable in the radial direction is often, on the one hand, the outward protrusion of the locking pin and, on the other, the increased space requirement needed, which makes it more difficult to construct particularly narrow and small plug connectors.

The object of the invention is to improve generic plug connectors and particularly their locking means to the effect that a very space-saving and narrow design of the plug connectors becomes possible.

This is achieved according to the invention by the locking pin being arranged, at least in the completely plugged-in position, inside the receiving jacket portion and/or the plug-in portion and being movable between its locking position, in which it locks the first plug component to the second lock component, and its unlocking position, in which the first plug component and the second plug component are unlocked, on a movement path, which has at least a tangential component as seen from the central longitudinal axis.

In other words, two things are provided according to the invention. First, the locking pin is arranged in such a manner that it is arranged, in the completely plugged-in position of the plug components, inside the receiving jacket portion and/or the plug-in portion and thus does not protrude outwardly. Second, between its locking position and its unlocking position, the locking pin is no longer moved in a radial direction relative to the central longitudinal axis but on a movement path, which has at least a tangential component. The movement path can thus definitely also have a radial component; however, it must have at least a tangential component, which is not the case in a purely radial movement. Particularly preferred are embodiments of the invention, in which it is provided that the movement path is arranged tangentially, as seen from the central longitudinal axis. In these variants, the movement along the movement path occurs solely in a tangential manner. The movement path thus no longer has any radial components at all in these embodiments. In preferred embodiments, the mentioned movement path runs at least in an angular range of +/−45°, preferably +/−30° about a purely tangential movement direction.

By the construction, according to the invention, of the plug connectors and their locking means, very small, space-saving plug connectors can be executed without having to curtail the reliability of the locking means. Particularly preferred embodiments of the invention provide that the locking means has at least two locking pins, which are arranged on mutually opposite sides of the central longitudinal axis and/or relative to a center plane running along the central longitudinal axis. The two locking pins are advantageously distanced from the central longitudinal axis, in other words at a distance greater than zero from it. A particularly stable locking means is hereby created.

Particularly preferred embodiments of the invention provide that the locking pin can be actuated by a pivotable locking lever of the locking means or is component of a pivotable locking lever. The locking lever can thereby be positioned about a fixed swivel pin in a pivotable manner. However, a pivotable mounting of the locking lever is also possible without a swivel pin by means of a bearing cup. With such a bearing cup, one can dispense with a physical actually present swivel pin.

At any rate, it is advantageously provided that the locking lever can be actuated by hand, wherein it is provided in a particularly preferred manner that the plug connector has an actuating surface for actuating the locking lever by hand. The physical swivel axis actually existing in the form of a swivel pin or the non-visible swivel axis, in the event of a socket bearing, about which the locking lever can be pivoted advantageously lies between the point and/or region at which the actuating surface acts on the locking lever in a direct manner or also via a push or pull element and the locking pin(s). Particularly favorable lever ratios are hereby realized so that with small movement strokes, a secure locking and unlocking is possible.

A first group of embodiments provides that the locking pin is seated in a first plug component and/or is part of the first plug component and engages in a locking counterpart of the second plug component for locking purposes. However, another group of embodiments according to the invention provides that the locking pins are seated in the second plug components and/or are part of the second plug component and engage in a locking counterpart of the first plug component. Advantageously, each locking pin is assigned its own locking counterpart. The locking counterpart(s) can be constructed e.g., in the form of an undercut, preferably level with the first or second plug component. In doing so, particularly preferred variants of the invention provide that the undercut forming the locking counterpart is arranged in the plug-in portion or in the receiving jacket portion. Pursuant to the movement path, according to the invention, of the locking pin(s) with at least one tangential component, preferred variants of the invention provide that the plug-in portion has a mushroom-shaped exterior contour, as seen in a frontal view, and/or the insertion opening of the receiving jacket portion has a mushroom-like contour, as seen in a frontal view. The transition between the plug-in portion and rest of the housing of the first plug component and/or between the receiving jacket portion and the rest of the housing of the second plug component is preferably constructed in a step-shaped manner.

The plug components of the plug connectors according to the invention can be executed both as a cable plug as well as a device socket. Both plug components of a plug connector can be cable plugs. This is provided when two cables are to be connected to each other. However, it can also be provided that a cable plug of one of the plug components of the plug connector is executed for being attached to a cable and the other plug component acting with it [is] a device socket, which is to be arranged or assigned to an electrical device, such as an amplifier. The cable plug can hereby be the first plug component and the device socket can hereby be the second plug component, or vice versa. The combination of cable plug and device socket is always selected when a cable is to be connected to a device via a corresponding plug connector.

Plug connectors according to the invention can be realized for a purely electrical connection, e.g., as audio plugs, but also as a purely optical plug connection. However, mixed forms are also conceivable, in which the plug connector serves to connect both electrical as well as fiber optic lines to each other. Regardless of the respective embodiment, it is provided in any case that the receiving jacket portion involves a type of cavity in the second plug component through whose cavity inlet in the form of the insertion opening, the plug-in portion of the first plug components can be inserted into the cavity.

Additional features and details of preferred embodiments of the invention are explained in the following descriptions of the drawings.

Figure 1:
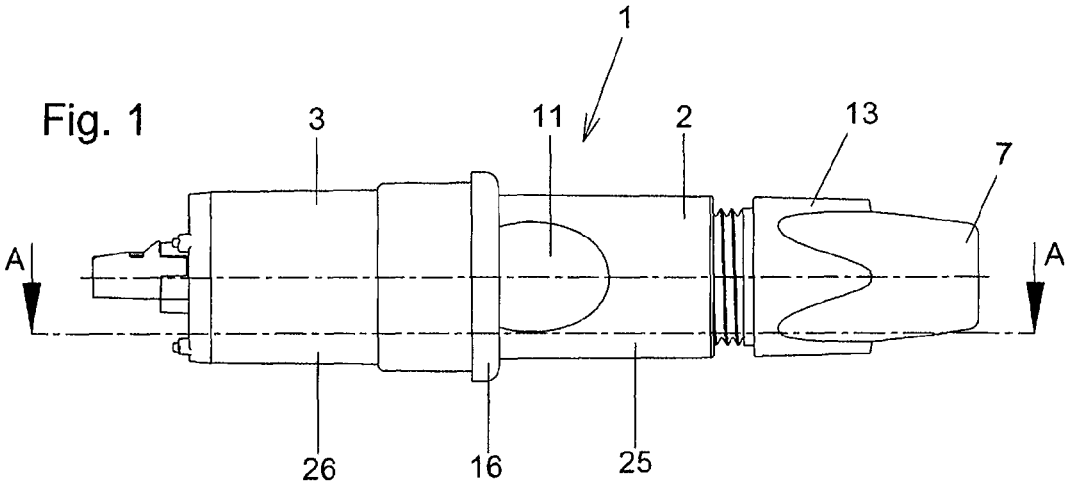
FIGS. 1 to 9 depict illustrations of a first embodiment according to the invention of a plug connector.
Figure 9:
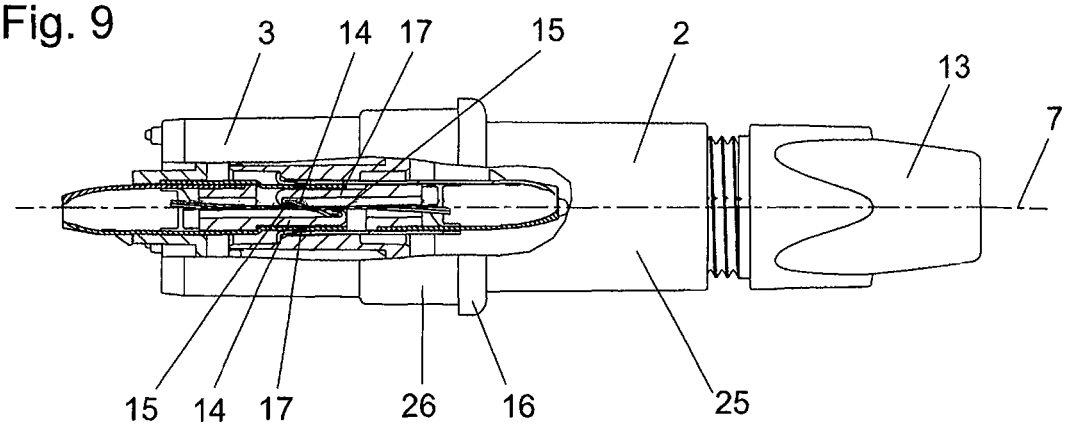
Figure 10:
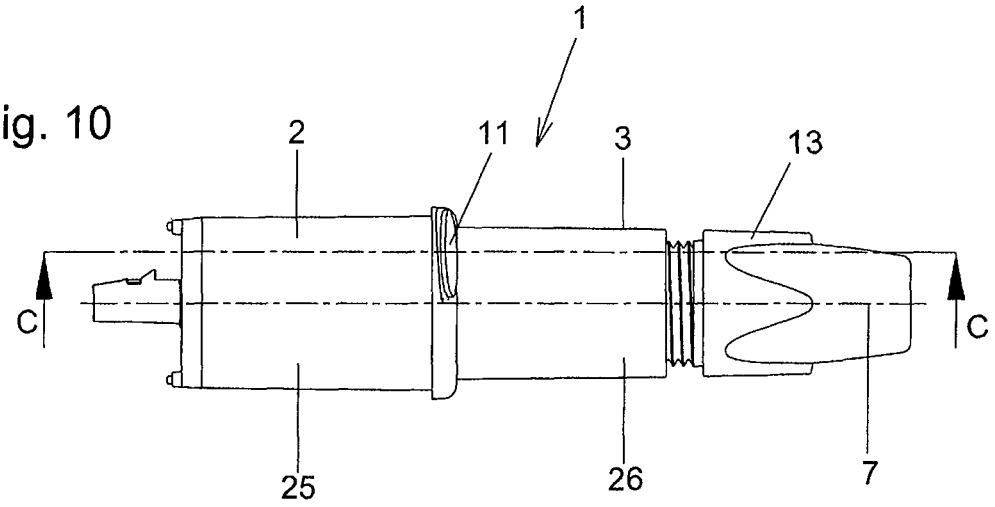
FIGS. 10 to 17 depicts illustrations of a second embodiment, according to the invention, of a plug connector

FIG. 1 shows the first embodiment of plug connector 1 according to the invention in the fully plugged-in position of first plug component 2 and second plug component 3. This embodiment involves a first plug component 2 and a cable plug. The cable not depicted here is inserted in a known manner per se through cable bushing 13 from the rear into the inside of housing 25 of first plug component 2, to there be connected to electrical contacts 15 pictured further down. In the first embodiment in FIGS. 1, 5, and 9 as well as the other embodiments in FIGS. 10, 14, and 17 to 20, cable bushing 13 is shown in a position in which it is not yet fully screwed into respective housing 25 or 26 of first plug component 2 or second plug component 3. In the fully plugged-in position, cable bushing 13 is screwed correspondingly far into respective housing 25 or 26. How far this screwing-in occurs can depend on the diameter of the cable.

In the first embodiment, the second plug component 3 involves a device socket whose housing 26, up to faceplate 16 is arranged in a concealed manner conventionally within the respective device. In the fully plugged-in position of the second plug component 3 in the respective device, all one can generally only see of said second plug component is faceplate 16 as well as receiving jacket portion 5.

In FIG. 1, one can see actuating surface 11 of locking means 8. The latter is located in a corresponding recess 18 in housing 25 of first plug component 2. To bring locking means 8 into its unlocked position, in which first plug component 2 can be pulled out of second plug component 3, one must press, e.g., with a finger, on actuating surface 11. To snap locking means 8 into the locking position, advantageously no hand-actuation of actuating surface 11 or locking means 8 is necessary. To this end, a corresponding preload or spring load of the locking means is advantageously realized in the direction toward its locking position. In the first embodiment, pretension spring 29, as can be readily seen in FIG. 5*a*, is provided for this preload.

Figure 2:
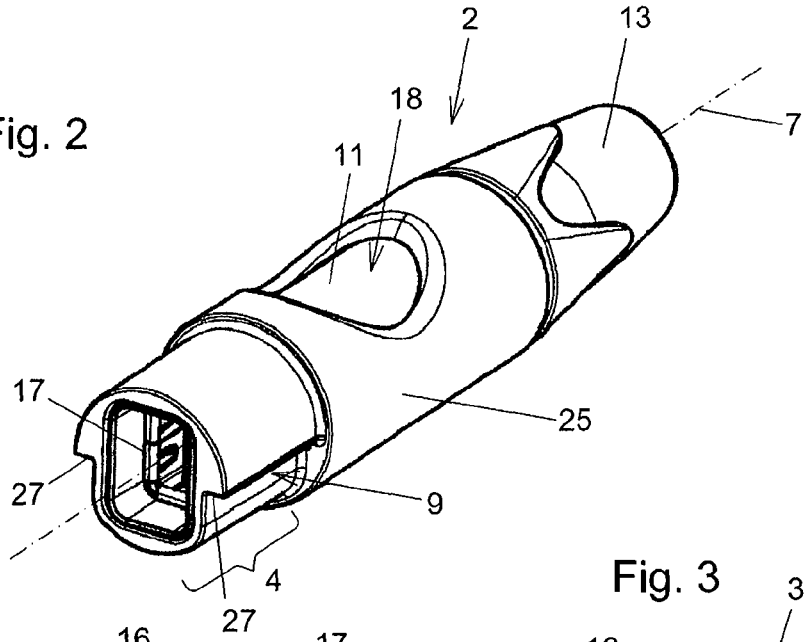
Figure 3:
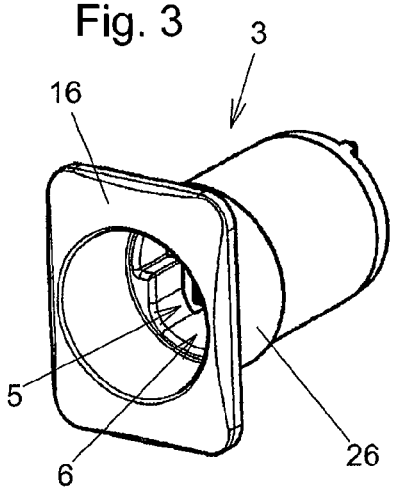
Figure 4:
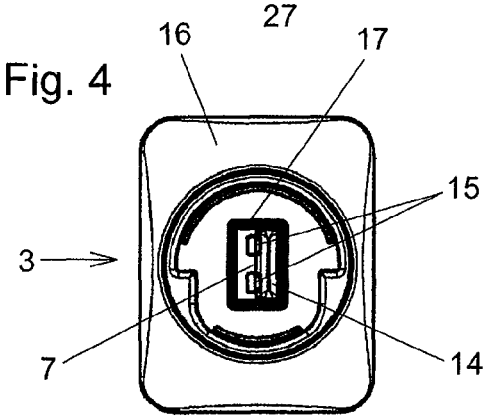

FIG. 2 shows first plug component 2, executed here in the form of a cable plug, with its elongate plug-in portion 4. FIG. 3 shows second plug component 3, constructed in this embodiment as a device socket, with receiving jacket portion 5, in other words practically the cavity, into which plug-in portion 4 of first plug component 2 can be inserted through insertion opening 6 of second plug component 3. Central longitudinal axis 7 is also drawn in in FIGS. 1 and 2. In the plugged-in position of first and second plug components 2 and 3, these plug components 2 and 3 are arranged coaxially to each other relative to central longitudinal axis 7. In the plugged-in position, there is a common central longitudinal axis 7 of both plug components 2 and 3. In FIG. 2, one can clearly see that in this preferred embodiment, plug-in portion 4 of first plug component 2 has a mushroom-shaped exterior contour. In FIG. 4, which shows a frontal view on to second plug component 3 and insertion opening 6, one can clearly see that insertion opening 6 of receiving jacket portion 5 also has, in this frontal view, a mushroom-shaped contour. The mushroom-shaped contours of plug-in portion 4 and receiving jacket portion 5 are constructed to correspond to each other so that plug-in portion 4 can be pushed through insertion opening 6 into receiving jacket portion 5. In a plugged-in position of plug components 2 and 3, this also results in a twist-proofing of both plug components 2 and 3 relative to each other. As can be seen particularly clearly in FIG. 2, this mushroom-shaped contour of plug-in portion 4 creates surfaces 27 in the exterior contour of plug-in portion 4, which run parallel to radial direction 20 (see FIG. 7). In preferred embodiments, like the one shown here, locking pins 9 are arranged in the region of these surfaces 27 running parallel to the radial direction.

This is indicated at least in FIG. 2, even if one cannot actually see locking pin 9 here.

As already mentioned earlier, embodiments according to the invention of plug connectors 1 can be constructed to create an electrical as well as an optical plug connection as well as combinations thereof. The embodiment shown is a purely electrical plug connection. In the depicted embodiment, it is constructed similar to a USB (universal serial bus) plug. This is readily seen in FIG. 4 as well as in FIGS. 6 and 9. In this type of electrical contacting, electrical contacts 15, constructed as leaf springs, of a respective plug component 2 or 3 are each supported on a plate-like contact carrier 14. Contact carrier 14 and electrical contacts 15 are arranged within a contact housing 17. The particular nature of this type of electrical plug connection consists of the two components to be connected to each other having the same geometry of the respective electrical contacts 15 and contact carrier 14. In FIG. 4, one can see by means of a view into receiving jacket portion 5 of second plug component 3 that in this embodiment, two electrical contacts 15 are provided on one contact carrier 14 per plug component. The number of electrical contacts 15 and also the size of contact carrier 14 can naturally vary. FIG. 6 shows a cross-section along line BB from FIG. 5. Here, one can clearly see how electrical contacts 15 of the two assembled plug components 2 and 3 lie against each other to thereby achieve the electrical contact. In the partially cut-away illustration of the plugged-in position of plug connector 1 in FIG. 9, one can see particularly well that contact housing 17 of respective plug components 2 and 3 engage with each other or encompass each other in a plugged-in position, and thereby outwardly seal off the region around electrical contacts 15. One can clearly see in FIG. 9 that in this embodiment, contact housing 17 forms a type of sealing sleeve around electrical contacts 15 and contact carrier 14.

Figure 5:
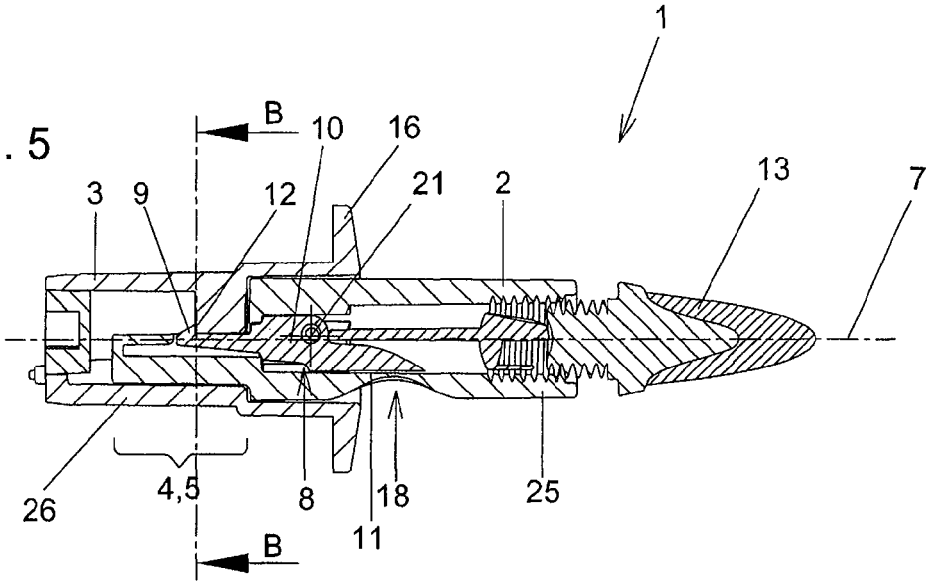
Figure 5A:
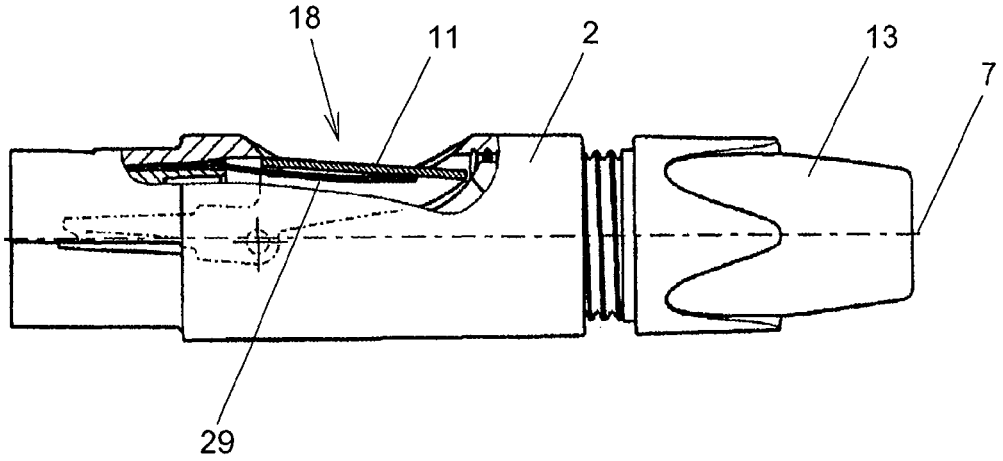
Figure 6:
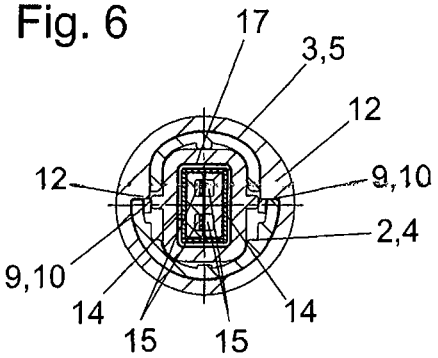
Figure 8:
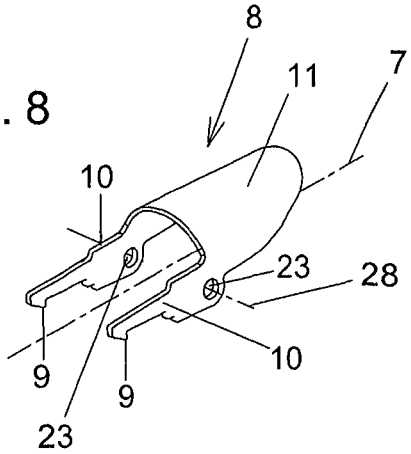

FIG. 5 depicts the longitudinal cut along line AA from FIG. 1. In this sectional plane is shown the functioning of locking means 8, shown separately once again in FIG. 8, of this embodiment in the plugged-in position of plug components 2 and 3 as depicted in FIG. 5. FIG. 5 shows the locking position, in which locking pins 9 of locking means 8 engage behind locking counterparts 12, constructed in the form of corresponding undercuts, of the second plug component 3 so that in this locking position, a pulling-out of the first plug component 2 from the second plug component 3 is prevented. In FIG. 5, one can also clearly see locking lever 10 of locking means 8, which is pivotably seated with axle holes 23, in this embodiment, on swivel pin 21 of a first plug component 2. Swivel pin 21 thereby forms the swivel axis. It lies between actuating surface 11 and locking pin 9, which, as mentioned previously, results in particularly good lever ratios, so that by means of a relatively small actuating stroke, a relatively large unlocking motion results, which is in the form of a pivoting of locking pin 9, arranged on locking lever 10, from the locked position depicted in FIG. 5 to the unlocked position not depicted here. In FIGS. 6 and 8, one can clearly see that, as can be provided in other preferred embodiments, locking means 8 has two locking pins 9 in this embodiment, which run on mutually opposite sides of central longitudinal axis 7 or along a plane, not depicted here, running along central longitudinal axis 7 and are at a distance from central longitudinal axis 7. In FIG. 8, one can also see axle holes 23 once again, in which engage swivel pins 21. Swivel axis 28, about which locking lever 10 can be pivoted and which runs through swivel pins 21 in the first embodiment, is depicted by means of a dashed line in FIG. 8.

Figure 7:
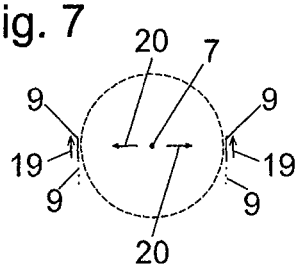

To illustrate the movement path, according to the invention, of locking pin 9 between its locking position and its unlocking position or vice versa, a schematized illustration is shown in FIG. 7. Only central longitudinal axis 7 and locking pin 9 are depicted here. In the depicted pulled-through state, locking pins 9 are in their locking position in which they grasp locking counterparts 12 from behind. In the unlocking position, which is depicted here in a schematized manner, locking pins 9 are shown in a dotted manner. The movement path between the unlocking position and the locking position and vice versa runs along tangential direction 19, as is illustrated by the corresponding arrows in FIG. 7. Tangential direction 19 is perpendicular to the respective assigned radial direction 20. As mentioned previously, the movement path is not required to run exclusively in tangential direction 19. It is also sufficient if it has a tangential component. However, it is preferably provided that the movement path runs at an angle of +/−45°, preferably +/−30°, about tangential direction 19 or just solely in tangential direction 19. This tangential movement path of locking pin 9 between its respective locking and unlocking positions results in a very minimal space requirement, by means of which it is possible to keep the exterior diameter of plug connector 1 small. In the embodiment achieved here, one can also mention another advantage in that locking pins 9 are essentially concealed in plug-in portion 4 by its special exterior contour, as was already mentioned earlier, and are thus protected against bending, breaking off, or other damage.

Figure 13:
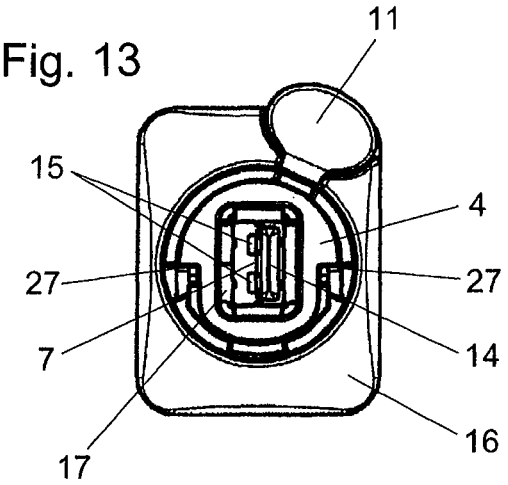
Figure 14:
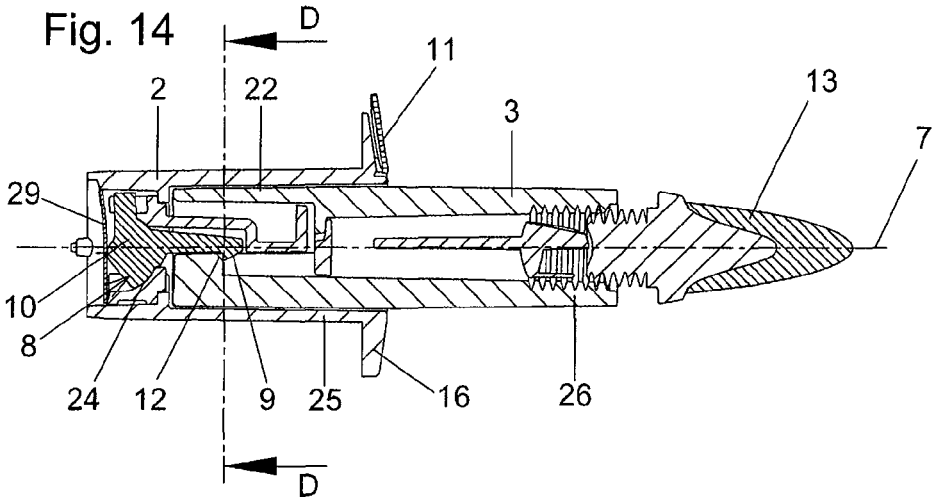
Figure 15:
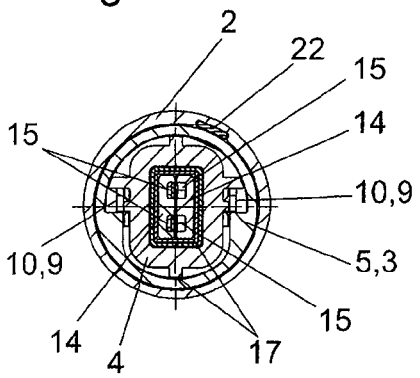
Figure 16:
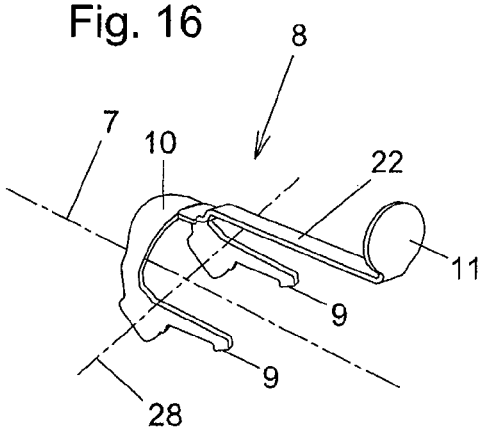
Figure 17:
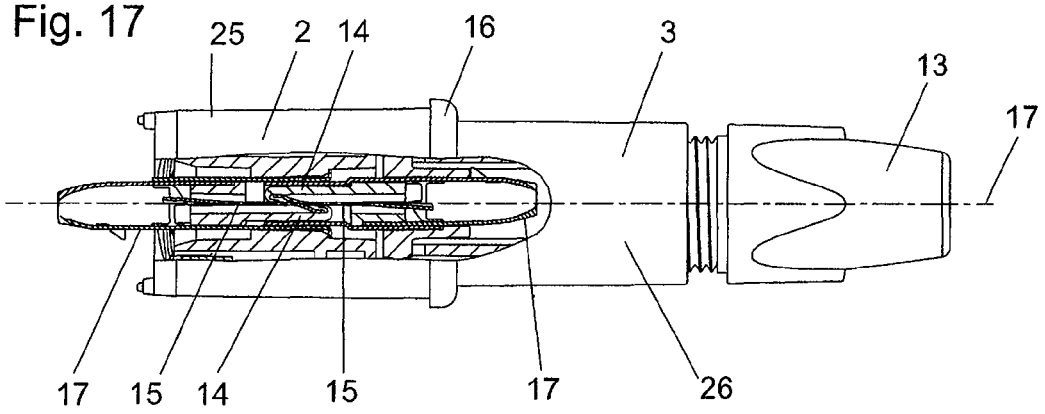

A second embodiment according to FIGS. 10 to 17 pertains to a plug connector 1 according to the invention, in which the first plug component 2 is constructed in the form of a device socket and the second plug component 3 is constructed in the form of a cable plug. In this embodiment, too, locking means 8 is part of first component plug 2. One can see this clearly on actuating surface 11 in FIG. 10, in which the plugged-in position is shown again. FIGS. 11 and 12 again show plug components 2 and 3 in a state where they are detached from each other. FIG. 13 provides a view on to plug-in portion 4 of this embodiment of first plug component 2; FIG. 14 shows the cross-section along line AA from FIG. 10; FIG. 15 shows the cross-section along line DD from FIG. 14; FIG. 16 shows the locking means 8 realized here detached from the other parts of plug connector 1 of this second embodiment. FIG. 17 shows in a manner essentially similar to FIG. 9 once again the electrical contacting in this embodiment, which is constructed as in the first embodiment.

Figure 11:
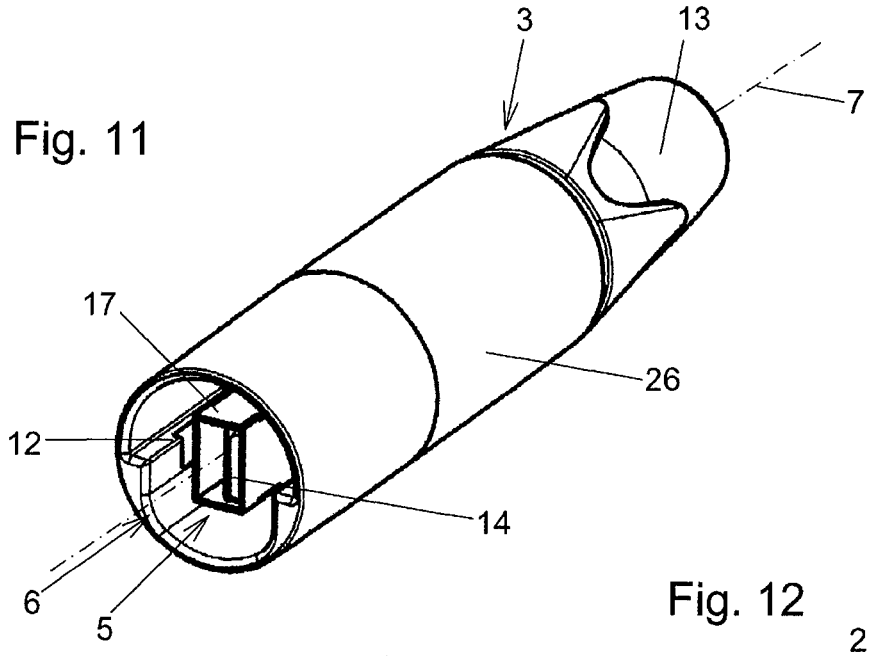
Figure 12:
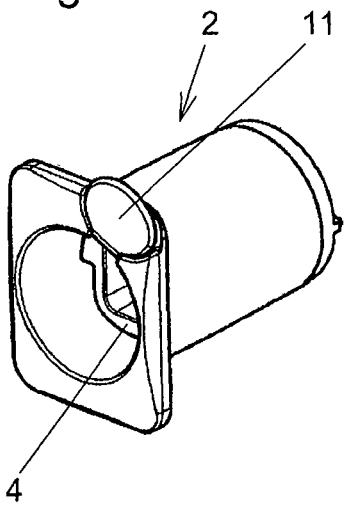

Besides the type of construction of the electrical contacts, there are many other commonalities between the second embodiment according to FIGS. 10 to 17 and the first embodiment according to FIGS. 1 to 9, so that essentially the differences will be addressed below. Otherwise, the explanations pertaining to the first embodiment can be applied correspondingly to this second embodiment. FIG. 11 provides a view through insertion opening 6 into receiving jacket portion 5 of second plug component 3 constructed here as a cable plug. One can clearly see on the one side locking counterpart 12, constructed in the form of an undercut, in receiving jacket portion 5. In the frontal view according to FIG. 13, one can clearly see plug-in portion 4 of first plug component 2 constructed here as a device socket. This plug-in portion 4 is inserted, in the plugged-in position, into receiving jacket portion 5 of second plug component 3. FIGS. 11 and 13 also illustrate that in this embodiment, both plug-in portion 4 and receiving jacket portion 5 have a mutually corresponding mushroom shape. Surfaces 27 are also constructed as in the first embodiment. These surfaces 27 are penetrated in turn by locking pins 9 of this embodiment. One can also clearly see in. FIG. 13 that actuating surface 11 is arranged in one corner of faceplate 16 having an essentially rectangular basic shape, by means of which there is a relatively small space requirement for faceplate 16 and actuating surface 11. This has the advantage that these plug components 3 in the form of device sockets can be arranged relatively close next to each other on a corresponding electrical appliance.

FIG. 14 shows particularly clearly the mode of action and the structure of locking means 8 of this second embodiment. FIG. 16 shows locking means 8 detached from the other components. Here, too, locking means 8 has a pivotably seated locking lever 10 and two locking pins 9 arranged on mutually opposite sides of central longitudinal axis 7. A first difference to the first embodiment is in the socket bearing of locking lever 10 implemented here. In contrast to the first embodiment, no swivel pins 21 are provided here. As one can see clearly in FIG. 14, locking lever 10 is instead pivotably seated in bearing cups 24 so that axle holes 23 can be dispensed with. Another difference to the first embodiment consists of actuating surface 11 not acting directly on locking lever 10 but via a thrust element 22. A commonality to the first embodiment is that the swivel axis 28 drawn in a dashed line in FIG. 16 is in turn arranged between locking pin 9 on the one hand and the region, in which actuating surface 11 acts on locking lever 10—here via thrust element 22—on the other. The already mentioned favorable lever ratios also result hereby, which allow a relatively large swivel movement of locking pin 9 by means of a relatively small stroke of actuating surface 11.

Thrust element 22 of this embodiment is constructed in the form of a very narrow, thin strap, which is guided in a space-saving manner through a corresponding small and narrow groove in the first plug component 2.

One can refer to FIG. 7 and what is stated there in regard to the movement paths, constructed according to the invention, of locking pin 9 between its locking and unlocking position. This applies to the first, the second, as well as the subsequently portrayed embodiments.

The preload of locking lever 10 in the direction toward the locking position according to FIG. 14 is achieved in this embodiment by pretension spring 29.

In this embodiment, pretension spring 29 simultaneously holds the contact carrier and bearing cup 24 in position.

It is also pointed out that first plug component 2 of the first embodiment and second plug component 3 of the second embodiment can also be joined into plug connector 1 according to the invention, e.g., when it is a matter of connecting two cables correspondingly to each other.

Figure 18:
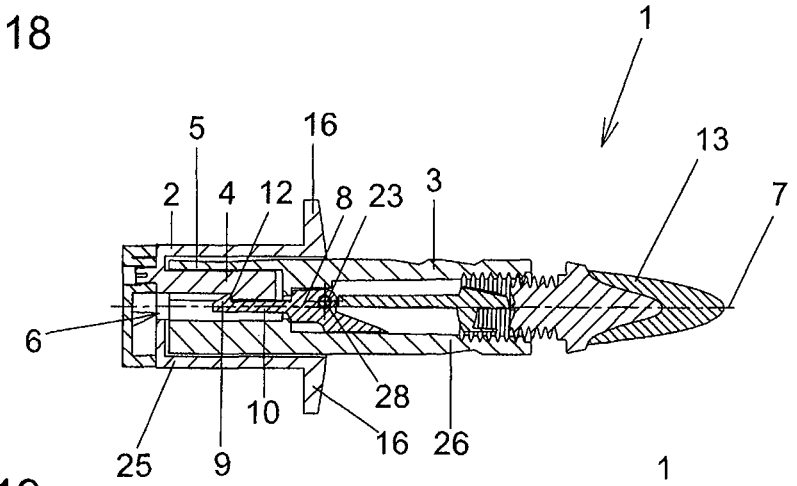
FIGS. 18 to 19 depict additional alternative embodiments of plug connectors according to the invention.
Figure 19:
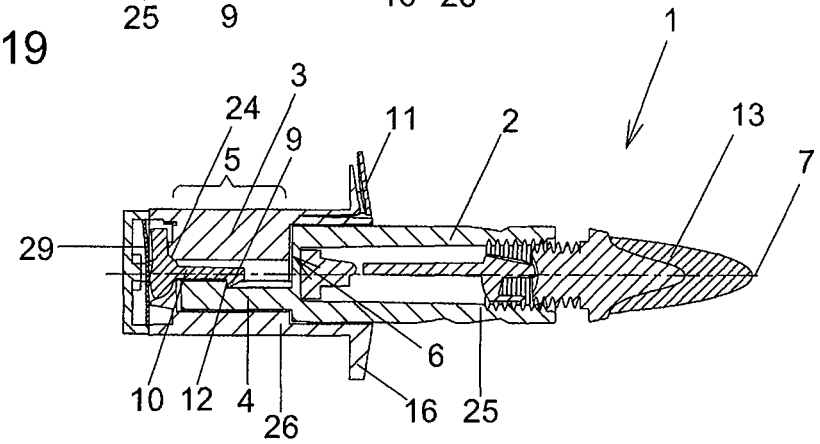
Figure 20:
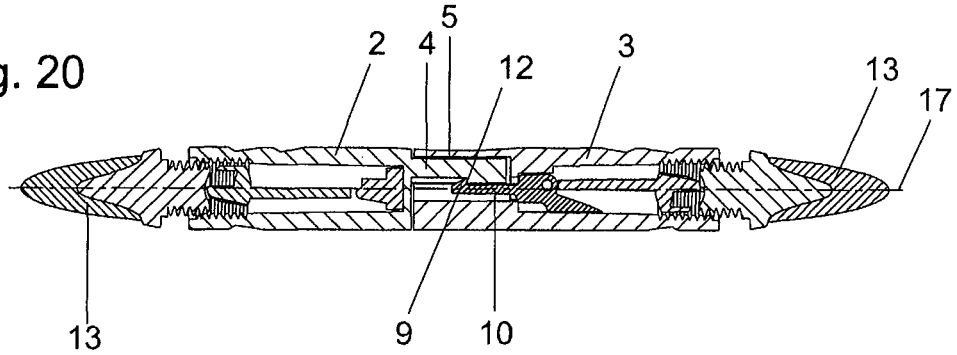
FIG. 20 depicts an illustration showing for example purposes that to connect two cables to each other, first plug component of a plug connector according to the invention can be inserted into second plug component of a plug connector according to the invention.

In the embodiments portrayed until now according to FIGS. 1 to 17, locking pins 9 and locking levers 10 are each mounted in first plug component 2, which has in each case an elongate plug-in portion 4, or are part of this first plug component in each case. In these embodiments, locking pins 9 then engage for locking purposes to locking counterparts 12 of second plug component 3 in each case. FIGS. 18 to 20 now show other embodiments of the invention in which this is reversed. In these embodiments, locking pins 9 and locking levers 10 are mounted in second plug component 3 or are part of this second plug component 3. In these embodiments, locking pins 9 engage, for locking purposes, with a locking counterpart 12 in each case, which is part of the first plug component 2.

In FIG. 18, first plug component 2 with plug-in portion 4 is constructed as a device socket, while second plug component 3 with its receiving jacket portion 5 pertains to a cable plug. In this embodiment, locking lever 10 is pivotably seated via swivel axis 28 in the second plug component 3. In the assembled locking state shown in FIG. 18 in a longitudinal cross-section, locking pin 9 engages a locking counterpace 12 in the form of an undercut from behind at plug-in portion 4 of first plug component 2 constructed as a device socket. Locking means 8, of this embodiment corresponds to FIG. 8. In regard to the position of pretension spring 29 and actuating surface 11, one can refer analogously to FIG. 5*a*. In this embodiment according to FIG. 18, locking levers 10 are thus also pivotable about a fixed swivel axis 28.

FIG. 19 shows another embodiment. Here, too, locking means 8 is constructed in or as part of second plug component 3. However, second plug component 3 is constructed here as a device socket. First plug component 2, which has plug-in portion 4 with locking counterpart 12, is constructed here as a cable plug. In the embodiment according to FIG. 19, locking lever 10 is mounted in an axle-less manner in a bearing cup 24 and pretensioned by means of pretension spring 29. This is released analogously to the variant according to FIG. 14. In the variant according to FIG. 19, the type of locking means 8 is essentially realized analogously to FIG. 16. Locking lever 10 is swiveled here by pressing on actuating surface 11 or when letting go of actuating surface 11 by pretension spring 29.

FIG. 20 shows for example purposes that to connect two cables to each other, first plug component 2 with its plug-in portion 4 from FIG. 19 can be inserted into second plug component 3 with its receiving jacket portion 5 from FIG. 18.

Also in regard to these just mentioned variants, it is provided according to the invention that locking pin 9 is arranged at least in the completely plugged-in position inside receiving jacket portion 5 and/or of plug-in portion 4 and is movable between its locking position, in which it locks the first with the second plug component 2, 3, and its unlocking position, in which first plug component 2 and second plug component 3 are unlocked, on a movement path, which has at least a tangential component when seen from central longitudinal axis 7. In regard to the tangential movement of locking pins 9, reference is also made again in this embodiment to the schematic diagram according to FIG. 7.

Lastly, it is also pointed out that housing 25 and 26 of plug components 2 and 3 and particularly their plug-in portions 4 and receiving jacket portions 5 can be produced of diverse materials, such as metal or plastic. Possible manufacturing processes are metal casting, metal injection molding, plastic injection molding, powder-metallurgical manufacturing processes as well as ablative methods such as milling or similar. Additive or generative methods known per se from prior art can also be used just as well for production purposes.

| Legend for reference numbers | |
|---|---|
| 1 | Plug connector |
| 2 | First plug component |
| 3 | Second plug component |
| 4 | Plug-in portion |
| 5 | Receiving jacket portion |
| 6 | Insertion opening |
| 7 | Central longitudinal axis |
| 8 | Locking means |
| 9 | Locking pin |
| 10 | Locking lever |
| 11 | Actuating surface |
| 12 | Locking counterpart |
| 13 | Cable bushing |
| 14 | Contact carrier |
| 15 | Electrical contacts |
| 16 | Faceplate |
| 17 | Contact housing |
| 18 | Recess |
| 19 | Tangential direction |
| 20 | Radial direction |
| 21 | Swivel pin |
| 22 | Thrust element |
| 23 | Axle holes |
| 24 | Bearing cup |
| 25 | Housing |
| 26 | Housing |
| 27 | Surface |
| 28 | Swivel axis |
| 29 | Pretension spring |

The invention claimed is:

1. Plug connector for at least one electrical or optical plug connection, wherein the plug connector has a first plug component and at least a second plug component and the first plug component has at least one elongate plug-in portion and the second plug component has at least one elongate receiving jacket portion with at least one insertion opening and the plug-in portion is pushed in, in a completely plugged-in position of the first and second plug components, through the insertion opening into receiving jacket portion and in a completely detached state of the first and second plug components is completely pulled out of the receiving jacket portion, wherein the first and second plug components in the completely plugged-in position are arranged coaxially to each other relative to a common central longitudinal axis and the plug connector has at least one locking means with two locking pins for the locking together of the first and second plug components in the completely plugged-in position, wherein the locking pins are arranged, at least in the completely plugged-in position, inside the receiving jacket portion and/or the plug-in portion and can be moved on a movement path between their locking position, in which they locks the first to the second plug component, and their unlocking position, in which the first plug component and the second plug component are unlocked, said movement path having at least one tangential component, when seen from the central longitudinal axis, wherein the plug-in portion has, in a frontal view, a mushroom-shaped exterior contour, and wherein surfaces are created in the exterior contour of the plug-in portion by the mushroom-shaped exterior contour of the plug-in portion, which run parallel to a radial direction with respect to the central longitudinal axis, and wherein these surfaces are penetrated by the locking pins.

2. The plug connector of claim 1, wherein the movement path, as seen from the central longitudinal axis, is arranged in a tangential manner.

3. The plug connector of claim 1, wherein the locking pins can be actuated by a pivotable locking lever of the locking means or are part of the pivotable locking lever.

4. The plug connector of claim 3, wherein the locking lever can be actuated by hand.

5. The plug connector of to claim 4, wherein the plug connector has an actuating surface for actuating the locking lever by hand.

6. The plug connector of claim 1, wherein the locking pins are mounted in the first plug component and for locking purposes engages with one or more locking counterparts.

7. The plug connector of claim 6, wherein the locking counterpart is an undercut.

8. The plug connector according to claim 7, wherein the undercut is in the plug-in portion.

9. The plug connector of claim 7, wherein the undercut is in the receiving jacket portion.

10. The plug connector of claim 1, wherein the locking pin is mounted in the second plug component and for locking purposes engages with a locking counterpart.

11. The plug connector of claim 1, wherein the locking pin is part of the first plug component and for locking purposes engages with a locking counterpart.

12. The plug connector of claim 1, wherein the locking pins are part of second plug component and for locking purposes engages with one or more locking counterparts.

13. The plug connector of claim 1, wherein the insertion opening of the receiving jacket portion, in a frontal view, has a mushroom-type contour.

14. The plug connector of claim 1, wherein at least one of the plug components is a cable plug.

15. The plug connector of claim 1, wherein at least one of the plug components is a device socket.

* * * * *